US006904858B2

(12) United States Patent
Pastore

(10) Patent No.: US 6,904,858 B2
(45) Date of Patent: Jun. 14, 2005

(54) SEA CHEST COVERS

(76) Inventor: Joseph Pastore, 70 Colonial Village, Falmouth, ME (US) 04105

( * ) Notice: Subject to any disclaimer, the term of this patent is extended or adjusted under 35 U.S.C. 154(b) by 37 days.

(21) Appl. No.: 10/197,105

(22) Filed: Jul. 17, 2002

(65) Prior Publication Data

US 2004/0011265 A1 Jan. 22, 2004

(51) Int. Cl.[7] ..... B63B 39/03
(52) U.S. Cl. ..... 114/125
(58) Field of Search ..... 114/125; 440/71, 440/72; 210/750; 427/517, 519, 520

(56) References Cited

U.S. PATENT DOCUMENTS 3,797,437 A 3/1974 Cowles
4,314,519 A * 2/1982 Yunoki et al. ..... 114/125
4,672,807 A 6/1987 Gongwear
5,049,287 A 9/1991 Pinder, III
5,322,569 A * 6/1994 Titus et al. ..... 210/748
5,358,749 A * 10/1994 Fears ..... 427/397.7
5,692,451 A 12/1997 Pastore
5,900,444 A 5/1999 Zamore
5,987,677 A 11/1999 Betker
6,274,232 B1 8/2001 Otten et al.
6,346,300 B1 * 2/2002 Ruepping ..... 427/517

* cited by examiner

*Primary Examiner*—S. Joseph Morano
*Assistant Examiner*—Lars A. Olson

(57) ABSTRACT

A sea chest cover for providing access to the sea chest of a ship. The sea chest cover includes both a cover element and a liner element received within the interior of the sea chest and is fabricated essentially entirely of one or more viscoelastic materials, preferably either polyethylene or polyurethane. Materials can be also made of copolymers, which may be laminated, and compression molded or portions may be blow molded. Fabrication of the sea chest cover from a viscoelastic material reduces or eliminates corrosion and erosion problems. It also minimizes marine organism and ice build-up. The result is a reduction in the expense of associated with maintaining such covers. The sea chest cover can also include an additive to reduce bacteria and algae growth and be irradiated with gamma rays for increased strength.

7 Claims, 1 Drawing Sheet

SEA CHEST COVERS

BACKGROUND OF THE INVENTION

This Invention relates to covers used in nautical applications to cover openings in the hulls of ships including submarines and other devices used in water environments especially in oceans, seas and large fresh water bodies such as the Great Lakes.

These hull openings, called sea chests and side thrust covers, usually take form of cavities of various shapes. To prevent water in the sea chests from entering the interior of a ship, these sea chests are sealed to the interior of the hull and are frequently an integral part of the hull.

Within the sea chest can be found valves to regulate intake or exhaust of water between the ship's interior and the ocean or whatever body of water surrounds the ship, for the purposes stated in my U.S. Pat. No. 5,692,451, which disclosure is incorporated herein by reference.

To prevent debris, floating material, shells and waste of any kind from entering a chest, a cover shaped to the contour of the ship's hull at the location of the chest, is applied to the chest opening. These covers are frequently made of cast iron or steel. Further, these covers are designed to allow passage of water between the chest and the ocean in response to pressure differences. This free passage is guaranteed by providing holes in the covers. These are drilled or are formed when the covers are fabricated from rods welded to form an array of spaced horizontal and vertical rods. Other manufacturing techniques exist. The holes or the openings in the grid act as filters to keep out debris and to allow free movement of water through the cover.

A major difficulty with the covers is the growth of algae, barnacle, etc. on the surface of both cast iron and steel covers. Such growth in time diminishes flow of water into and out of sea chests putting pressure on the pumps used to move the water, and changing the rate at which the water is moving.

Another difficulty arises from the oxidizing of the covers, especially of those formed from cast iron. Both the cast iron and the steel covers suffer from deposits of salts due to the electrolytic reactions stemming from the dissimilar metals of hull and covers in a bath of essentially dissociated ionic salts. To overcome these shortcomings, the covers are painted with anti fouling paints. This remedy is at best moderately successful and expensive since the procedure requires the ship to be in dry dock. The procedure is cyclical. Any breaks in the thin protective coat of paint become a starting point for erosion.

A third problem arises from pitting of the metal surface of the covers and from the inherent crystalline formation especially of the surface of the cover. The erosion caused by scouring effect of a ship's movement in the water and the release of dissolved air bubbles in bursts of high speed micro bubbles, in time flake off paint and pit the metal of the covers. This pitting enhances the growth of barnacles, algae and other forms of marine life by supplying a foothold or anchor to the metal covers. From this point on, the rate of erosion increases due to the waste given off by the marine organisms.

Finally, in journeys in cold waters, ice crystals grow on the metal covers because the covers are excellent heat conductors and release heat energy to the cold water and at equilibrium ice crystals form because the pitted surface of the covers act like nuclei for the attaching of ice crystals.

Heating techniques to remove the ice, though effective, proved to be prohibitively expensive. The remedy in all such cases is periodic removal of the ice, a task for divers, or again putting the ship in dry dock, either way an operation both costly and time consuming.

The invention disclosed in U.S. Pat. No. 5,692,451 proposed a one-time remedy for these problems at sizeable savings in time and money. The problems, as pointed out previously, stem from the following facts:

1. Debris that must be kept out of the sea chests impinging on the sea chest cover and damaging the thin coating.
2. The rough surface of cast iron and of steel exacerbate the problem by pitting due to turbulence as water passes over or through covers causing destructive gas bubble pressures.
3. Different metals in an electrolytic solution cause deposition of ionic salts.
4. Diminishing efficiency of covers as marine growth changes the effective shape of waterways through the covers
5. Increase in turbulence and noise from changes in cover configuration and in growth of marine life attached to the cover.
6. Deposits of ice when ship operates in cold waters.

The remedies flow from the invention design and are not simply applied to some base structure. The invention explicitly calls for the construction of sea chest covers from viscoelastic plastic to replace cast iron, steel, fiberglass or other metals or alloys. Among the effective plastics are the ones in the class of polyurethanes, high density and ultra-high density polyethylenes and copolymers thereof. These may be compression molded. The plastics mentioned and others of like characteristics exhibit the following properties:

1. Ability to be fabricated with tough, smooth high-density skin. The advantages gained are the following: algae and other marine life forms requiring an anchor for food to be transported to them, cannot form these anchors on a surface essentially free of pit marks.
2. All edges on the covers as depicted in this invention are formed with a radius rather than with square sharp edges to reduce turbulence.
3. Compared to cast iron and steel, the viscoelastic plastics of the covers cushion vibration and reduce noise generated both from the water moving through the grid of the cover and from hull vibrations.
4. The need for anti fouling paint to protect the covers no longer exists.
5. Hard ice will not form on the covers since no sites to act as nuclei exist on the smooth plastic surface.

SUMMARY OF THE INVENTION

While the formation of the covers from viscoelastic materials aided immensely in the remedy of the deficiencies noted in connection with the prior art covers, it was ascertained that the strength of the covers could be further enhanced by subjecting the viscoelastic materials of the cover to gamma ray radiation during the fabrication process which will cause the molecules of the materials to cross-link and readily adhere to each other. It has also been discovered that certain polymer additives to the viscoelastic material will also aid in reducing bacteria growth in the sea chest. But, even with these improvements in the sea chest covers, the deterioration of the sea chest within the ship's hull was not altogether alleviated, but slowed.

Accordingly, this invention offers a solution by forming the cover with attachable extension to form a liner for the inner wall of the sea chest which will seat within the sea chest and be capable of being connected for example, to ballast valving. The liner is fabricated from the same irradiated viscoelastic material of the cover to achieve absorption of impact by debris in the water, anti-fouling, minimum algae and bacteria growth and enhanced strength.

BRIEF DESCRIPTION OF THE DRAWINGS

Further objects and advantages of the invention will become apparent from the following description and claims and from the accompanying drawings, wherein:

PREFERRED EMBODIMENT

The preferred embodiment of the invention is depicted in the three drawing views. Radii of curved sections are drawn to suggest matching to surrounding hull sections or interior sea chest walls and do not suggest preferred curves. The covers to sea chests are sized to fit the openings of the chests and/or provision in hull design to support the covers, as are the liners.

Figure 1:
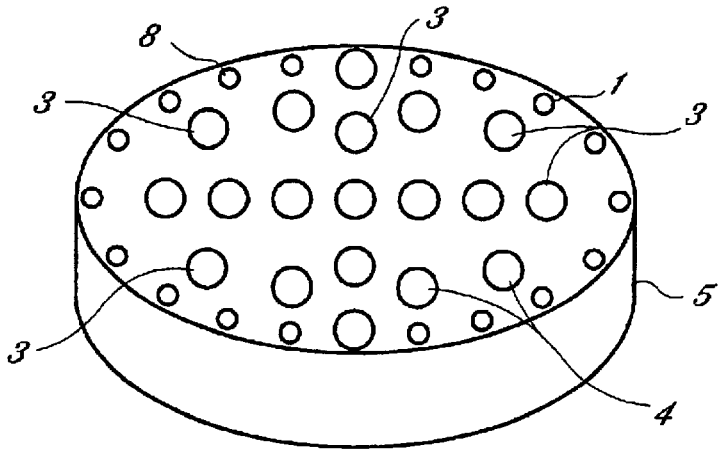
FIG. 1 is a perspective view of a typical sea chest cover.
Figure 2:
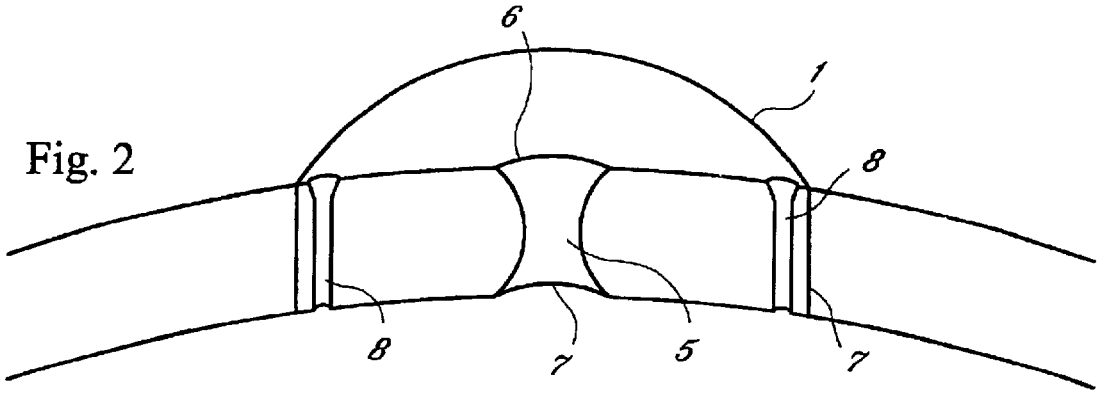
FIG. 2 is a longitudinal cross-sectional view through the sea chest cover of FIG. 1.
Figure 3:
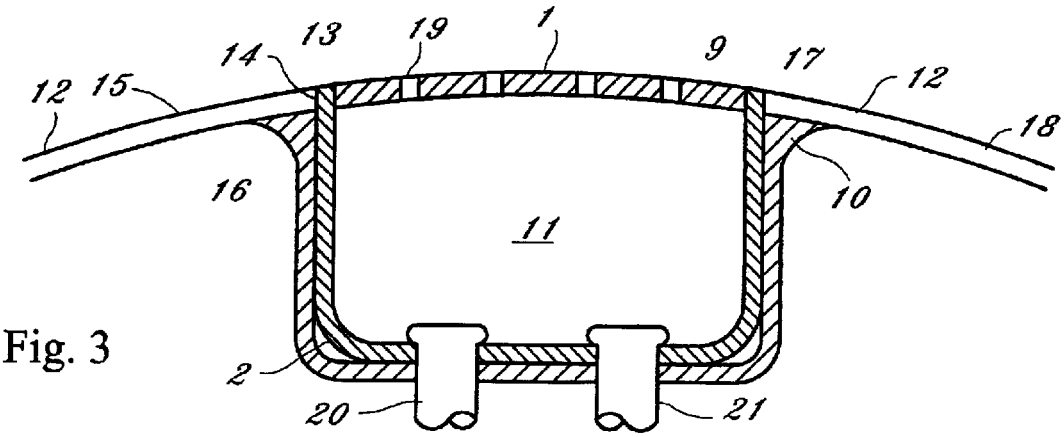
FIG. 3 is a cross-sectional view of the sea chest cover of FIG. 1 attached to a liner placed in close proximity to the interior wall of the sea chest.

FIG. 1 is a perspective view of a typical sea chest cover 1 having a thickness whose actual dimension is a function of actual location on a hull and actual pressures imposed on it. FIG. 1 shows a plurality of holes 3 spaced about 2" on center 4 and having diameters that allow for the flow rate of water required. These holes are tapered 5 as depicted in FIG. 2 showing upper 6 and lower edges 7 of the holes 5 possessing a radius of curvature for increased flow adjacent the upper and lower edges. FIG. 1 shows a series of circumferential holes 8 through the cover 2 countersunk to allow tapered flat head bolts 9, as shown in FIG. 3, to secure cover 1 to a U-shaped liner 2 seated within the interior of a sea chest 11. The sea chest 11 is shown with retainer ring 10 as an integral part of sea chest 11. Retainer ring 10 is integral to or attached to inner surface 12 of hull 18, as in FIG. 3 so the cover 1 is flush with outer surface 17 of hull 18. A gasket 16 can separate lower surface 19 of cover 1 from upper surface 17 of liner 2. The ring 10 and integral sea chest 11 can be cemented to the interior wall of the hull. Ballast valves 20, 21 or the like can extend through both the sea chest wall and liner.

Both the liner 2 and cover 1 are formed from viscoelastic material as defined, and the material is irradiated with gamma rays during the fabrication process for enhanced strength. A polymer sold by Rohm and Haas Chemical Co. has been found to be especially useful in retarding bacterial and algae growth on the sea chest and liner walls when admixed with the viscoelastic material. This polymer is identified by the generic formulation 4,5-dichloro-2-n-octyo-4-isothiazolin-3-1.

I claim:

1. A sea chest cover comprising a cover element constructed of high tensile, high sheer strength viscoelastic material in combination with a separate liner element of the same material depending from the cover element and adapted to be seated within the interior of a sea chest, said liner extending downwardly from the cover element into said sea chest and having side walls adjacent the side walls of said sea chest, the side walls of said liner being connected adjacent a bottom wall of said sea chest.

2. The combination of claim 1 where the cover element is bolted to the top of said liner element.

3. The combination of claim 1 wherein said viscoelastic material is irradiated with gamma ray radiation for enhanced strength.

4. The combination of claim 1 wherein said viscoelastic material has an antibacterial and algae growth additive.

5. The combination of claim 1 having countersunk openings in the cover element which extend completely through the cover element adjacent its outer edge.

6. The combination of claim 5 where bolts received in said countersunk openings are threaded into the top of said liner element.

7. The combination of claim 1 wherein said liner is U-shaped in cross-section.

* * * * *